US005378072A

United States Patent [19]

Gunderson

[11] Patent Number: 5,378,072

[45] Date of Patent: Jan. 3, 1995

[54] TRANSFER MATERIALS SUPPLIER

[75] Inventor: Ernest M. Gunderson, Minneapolis, Minn.

[73] Assignee: Fargo Electronics, Inc., Eden Prairie, Minn.

[21] Appl. No.: 121,752

[22] Filed: Sep. 14, 1993

[51] Int. Cl.[6] ..... B41J 29/02

[52] U.S. Cl. ..... 400/692; 400/236

[58] Field of Search ..... 400/208, 242, 246, 247, 400/250, 613, 690.4, 692, 236, 236.2; 346/145; 242/67.1 R, 198; 354/288 R

[56] References Cited

U.S. PATENT DOCUMENTS

| | | | |
|---|---|---|---|
| 4,676,679 | 6/1987 | Kondo | 400/247 |
| 5,193,919 | 3/1993 | Godo et al. | 400/690.4 |

FOREIGN PATENT DOCUMENTS

| | | | |
|---|---|---|---|
| 0139470 | 6/1986 | Japan | 400/692 |
| 63-47179 | 2/1988 | Japan | 400/692 |
| 2-014174 | 1/1990 | Japan | 400/692 |
| 4-166373 | 6/1992 | Japan | 400/692 |

*Primary Examiner*—Ren Yan

*Attorney, Agent, or Firm*—Kinney & Lange

[57] ABSTRACT

An entry controlled ribbon core engager for a recorder having an interior space accessible through a selectively movable cover when in an open position during which providing or removing of a ribbon cassette with a supply ribbon thereon may be effected. The ribbon core engager has a rotatable drive hub portion and a rotatable and axially movable positioning hub portion that are selectively rotatable about a hub axis to engage and correspondingly force rotation of a ribbon core when said drive hub portion is rotated. A motion converter connected to both said cover and said positioning hub permits movement of said positioning hub portion axially back and forth along said hub axis when said cover is correspondingly moved between said open and closed positions therefor.

9 Claims, 7 Drawing Sheets

36
38
52A
174A
78
180
80
66
40
62A
76
70
42A
58A"
68A
112
46A
72A
58A'
174B
56A
44
47A
48A
57A'
57A"
54
64A 174A
38
112
52B
78
182
80
66
76
40
62A
70
180
42A
58A"
68A
46A
72A
58A'
174B
56A
44
47A
48A
57A'
57A"
54
64A

TRANSFER MATERIALS SUPPLIER

BACKGROUND OF THE INVENTION

The present invention relates to recorders such as printers and, more particularly, to such printers depositing materials on recording sheets from a transfer ribbon based materials supply to provide a print image.

The use of personal computers and, correspondingly, desk top printers controlled in part by such computers has increased very rapidly over the last several years. Many different printing technologies have been developed for these devices beyond that used in the impact printers initially performing in this role, including ink jet, thermal wax transfer and thermal diffusion, or dye sublimation, printing technologies.

These last technologies have been especially important in the growth of color printers, those having the capability of providing a colored image on a recording medium. The order of listing of these printing technologies above is typically the order of the quality of the results obtained in using them with ink jet technology generally providing the poorest quality of these technologies, and thermal diffusion giving the best. The order of listing is typically also the order of cost with ink jet printers generally being cheapest and thermal diffusion printers being the costliest.

The desire for high quality in images recorded by such printers has led to those printers having often provided therein substantial computing capabilities in their own right to permit close control or electrical currents through the resistors in the thermal printhead which, in each supplying heat to the coloring material source to direct material therefrom onto the recording sheet, leads to each effectively providing a corresponding color constituent of a pixel, on that sheet. In addition, extensive mechanical systems with expensive components such as high speed and high precision stepper motors, are usually used in such printers. Among such mechanical systems typically used in such printers is a supply ribbon transport system, at least in the last two types of printer technologies listed above, thermal wax transfer and thermal dye diffusion. Such a system is used to transport the next of a repeating sequence of color panels under the thermal printhead in the printer each having therein the coloring materials in or on the ribbon fabric to be supplied for deposition on a recording sheet to thereby provide a corresponding primary subtractive color on that sheet for a print image being formed thereon.

Such supply ribbons are usually provided wound about a ribbon core typically formed of plastic or relatively thick cardboard. Because inserting such a core into a printer, and winding the end of the ribbon a bit about another ribbon core, the take-up core, is often a messy and somewhat intricate operation, supply ribbons are often supplied in a ribbon cassette, or cartridge, in which the supply ribbon and two cores are provided, the supply core and the take-up core. Initially, most of the supply ribbon is wound about the supply core with a small portion wound about the take-up core, and the cassette is inserted as a whole into a printer.

Inserting, or removing, a supply ribbon cassette into or from a printer, however, is also often a somewhat involved task. The interior of a printer is typically densely filled with various components, and often quite exact positioning is required in inserting a cassette to permit its engagement with a drive mechanism for the take-up core while fitting it into the available space. Further, there must be provision made for having the inserted supply ribbon being ultimately positioned between the printhead and the recording sheet. Removal of the cassette usually brings similar problems in the opposite direction. Thus, there is a desire for a convenient arrangement for inserting supply ribbon cassettes into, and removing them from, a printer.

SUMMARY OF THE INVENTION

The present invention provides a ribbon core engager for a recorder, such as a printer, having an interior space in which the ribbon core is to be provided with a supply ribbon at least partially wrapped about it, access to this space being provided by a cover which can be opened to permit the core to be inserted and removed from the interior space and closed to prevent access for these purposes. The ribbon core engager comprises a drive hub means with a drive hub portion that can be rotated about a hub axis, and can be forced to engage the ribbon core at an engagement means therein by forcing a positioning hub portion of a positioning hub means against the opposite end of the core. This force is applied when the cover to the interior space is closed, and removed when the cover is opened, by having the cover connected by a motion converter to the positioning hub means. A ribbon core is most conveniently introduced into the interior space of the recorder when the cover is open by providing it in a cassette which can be placed into that space. The cassette will have a take-up core portion and a supply core portion holding corresponding cores therein by circumferential bands, and joined together by a pair of arms such that there is a notch formed in which the cassette is supported when the ribbon core is not forced against the engagement means of the drive hub portion.

DETAILED DESCRIPTION OF THE PREFERRED EMBODIMENTS

Figure 1:
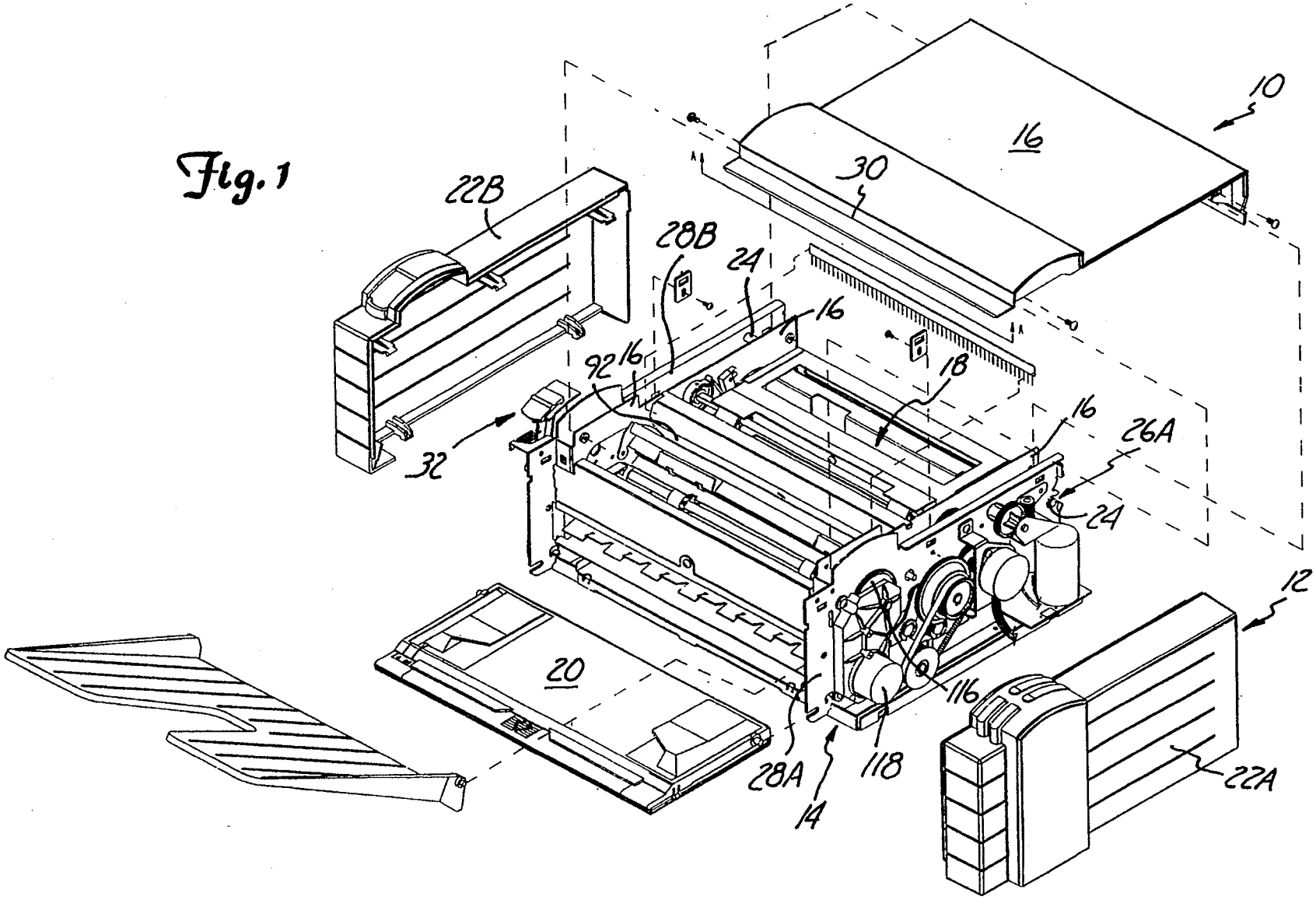
FIG. 1 is an exploded perspective view of a recorder embodying the present invention.

FIG. 1 shows an exploded perspective view of a recorder, 10, embodied here as a printer, with a printer housing, 12, exploded away from a printer body, 14. Printer housing 12 includes a cover assembly, 16, for allowing accessibility to both printer body 14 and a space, 18, interior thereto, and to support a printhead assembly with part of its operating mechanism, the cover assembly being shown separated in this figure; a paper tray, 20, for supporting and properly positioning a sheet, typically paper to be recorded upon; a right end cover, 22A; and a left end cover, 22B. Each end cover provides access to various electrical switches and mechanical releases. Printer body 14 comprises numerous electrical, mechanical and structural parts, mounted on and through a generally rectangular frame structure.

Cover assembly 16 has a rotational shaft, 24, attached thereto with this shaft slidably rotating in a first retaining groove, 26A, provided in a right side frame member, 28A, of printer body 14, and in a second retaining groove (not shown) provided in a left side frame member 28B, of printer body 14. Left side frame member 28B is adjacent to left end cover 22B when that cover is fastened to printer body 14. Right side frame member 28A being adjacent right end cover 22A when that cover is fastened to printer body 14. Rotational shaft 24 can be caused to rotate first retaining groove 26A and second retaining groove (not shown) by moving cover 16 such that cover 16 has a closed position when a front portion, 30, thereof is rotated toward the front of printer body 14 to engage with a locking mechanism, 32, provided at the front of that body. Cover 16 has an open position when front portion 30 of cover 16 is disengaged therefrom locking mechanism 32 and is rotated toward the rear of printer body 14.

Figure 6:
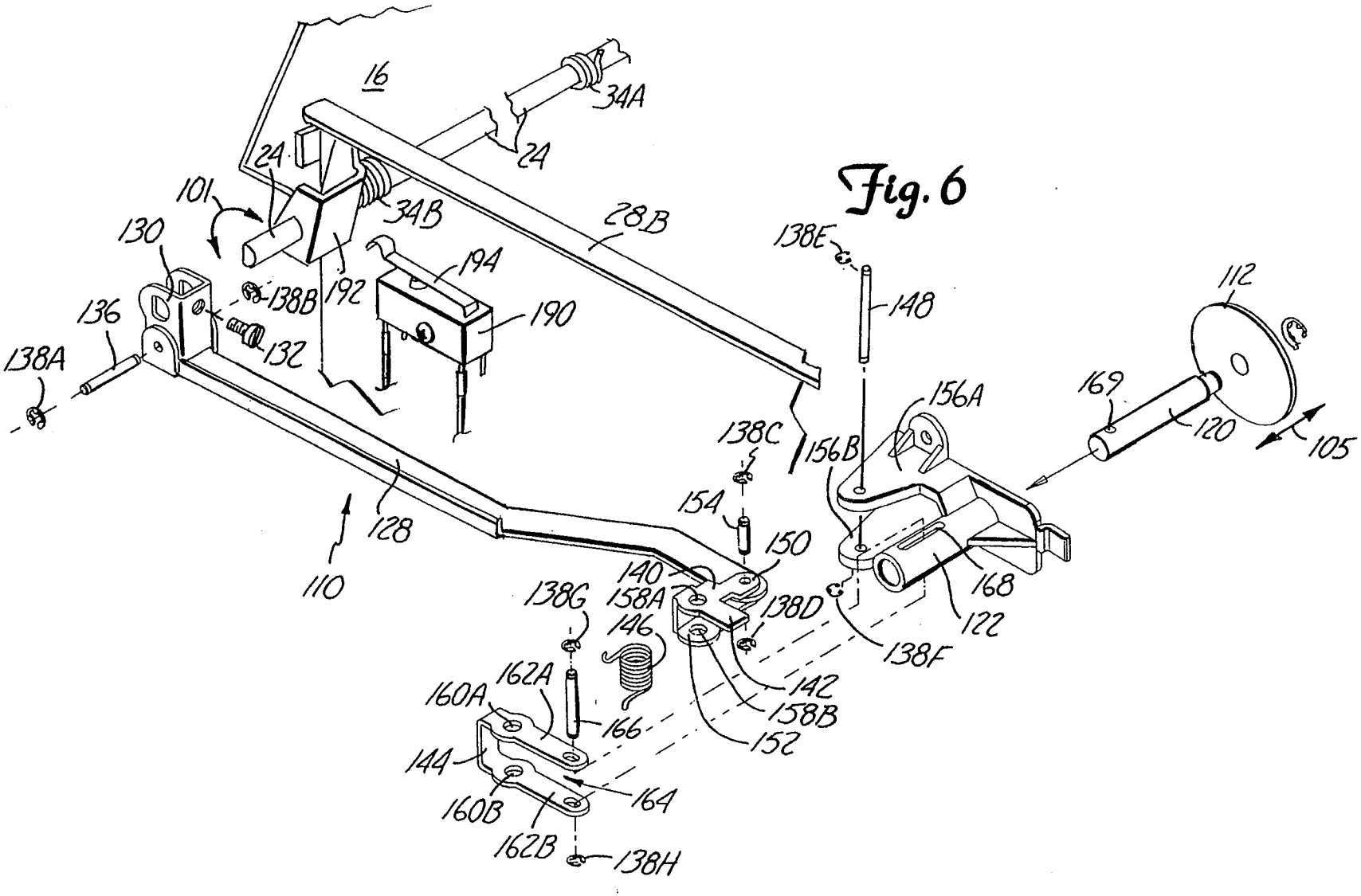
FIG. 6 is an exploded view of a portion of the recorder in FIG. 1.

Once cover assembly 16 is disengaged, front portion 30 thereof is urged to rotate upward and away from locking mechanism 32 about rotational shaft 24 because of spring action. This spring action is the result of a first torsion spring, 34A, as shown in FIG. 6, that is fitted concentrically about rotational shaft 24 and attached to cover 16 and right side frame member 28A of printer body 14, and of a second torsion spring, 34B, also shown in FIG. 6, that is fitted concentrically about rotational shaft 24 and attached to cover 16 and left side frame member 28B of printer body 14. Both springs 34A and 34B are wound and attached such that front portion 30 of cover 16 is urged to rotate upward and away from printer body 14 and into at least a partly open position.

Figure 4:
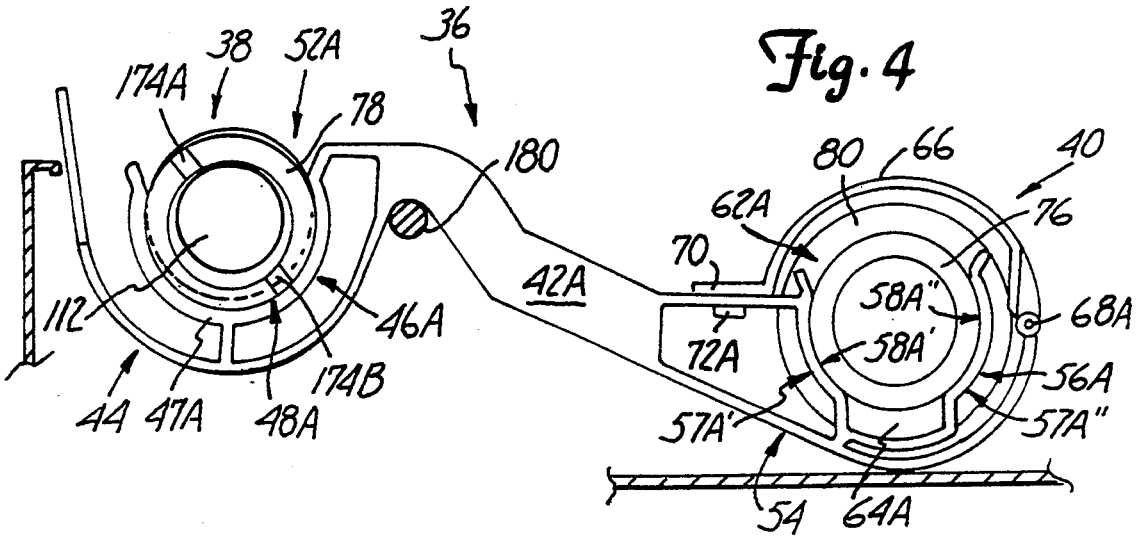
FIG. 4 is a side elevational view of a ribbon cassette for use in the recorder of FIG. 1.
Figure 5:
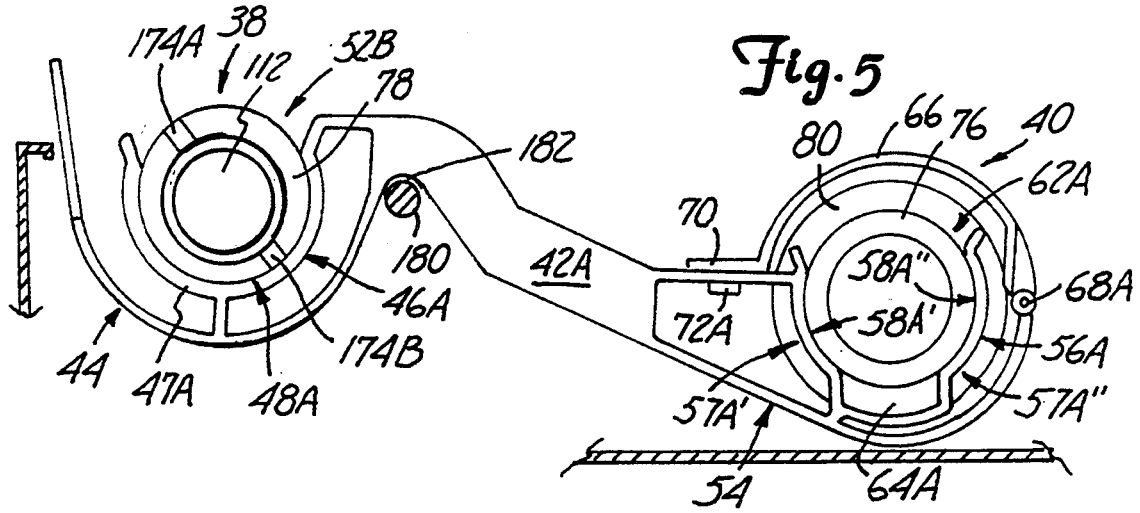
FIG. 5 is a side elevational view of the ribbon cassette of FIG. 4.

FIG. 1 shows printer body 14 in combination with cover assembly 16, paper tray 20, right end cover 22A, and left end cover 22B after assembly together result in a printer structure having therein interior space 18, which is accessible through opening cover assembly 16. In interior space 18, a ribbon cassette, 36, can be alternatively inserted and removed when cover 16 is in the open position. Ribbon cassette 36, as shown in FIGS. 4, 5 and 8, comprises a plastic assembly having a take-up core holding portion, 38, and a supply core holding portion, 40, attached to one another by a pair of connecting arms, more particularly a first connecting arm, 42A, and a second connecting arm, 42B.

Figure 8:
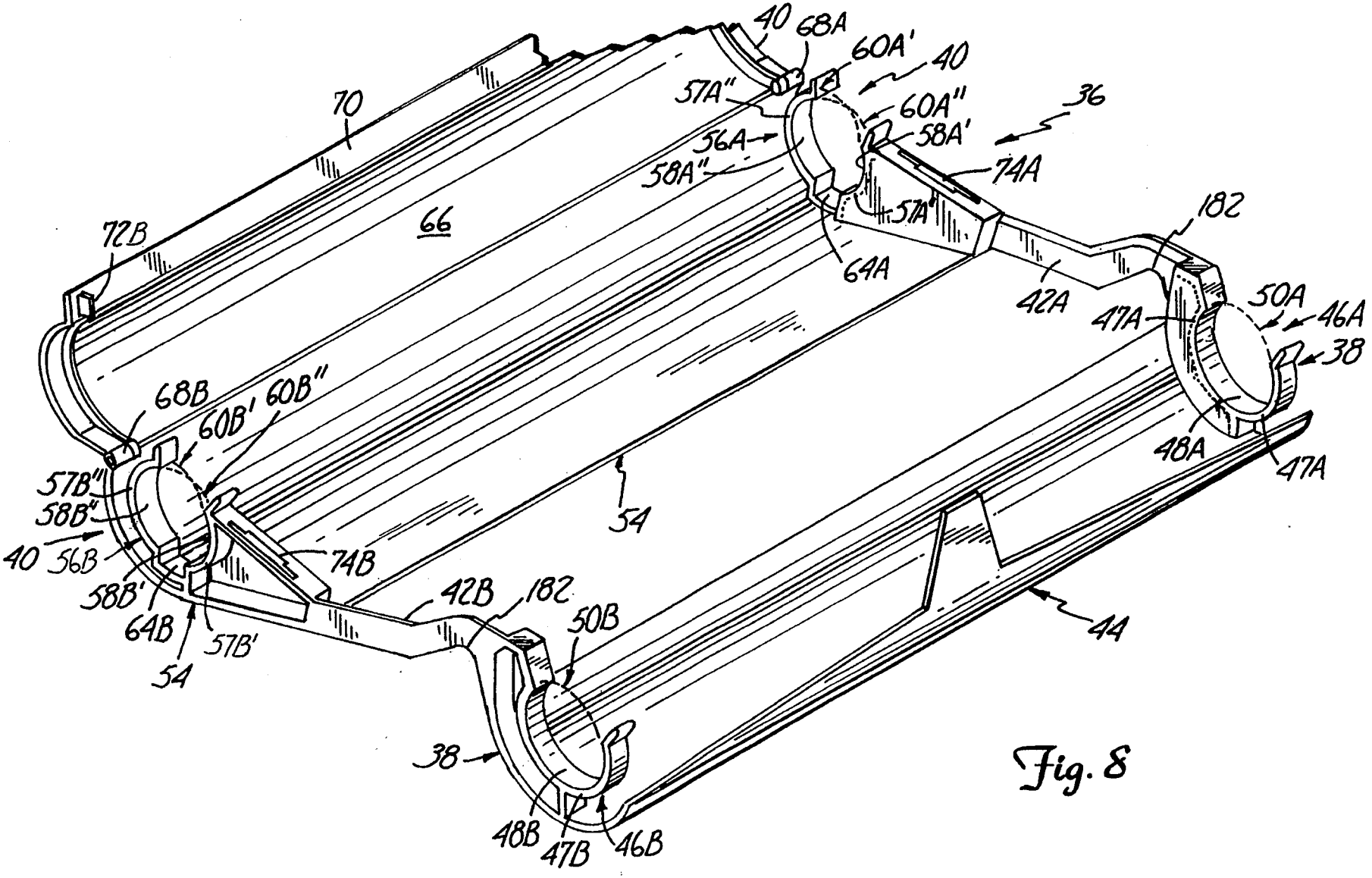
FIG. 8 is a perspective view of a portion of the ribbon cassette of FIG. 4.

Take-up core holder portion 38, as shown in FIG. 8, has a substantially semi-circular base, 44, and a first pair of spaced apart core positioners or cradles therein, more particularly a first cradle, 46A, attached to semi-circular base 44 near one end of take-up core holder portion 38, and a second cradle, 46B, attached to semi-circular base 44 near the opposite end of take-up core holder portion 38. Each of cradles 46A and 46B are formed of a resilient material band, 47A and 47B, typically of a polymer material, each having an interior surface, 48A and 48B, where each interior surface follows a portion of a first circular arc path, 50A and 50B, (shown in part) the interior surface extending beyond a semicircle, but not completing a circle due to a pair of take-up core gaps, 52A and 52B, in said band which provides access to that columnar space partially surrounded by said band.

Supply core holder portion 40, as shown in FIG. 8, has a base, 54, and a second pair of spaced apart core positioners or cradles therein, more particularly a third cradle, 56A, attached to base 54 near one end of supply core holder portion 40, and a fourth cradle, 56B, attached to base 54 near the opposite end of supply core holder portion 40. Each of cradles 56A and 56B are formed of a pair of opposing band portions, more particularly a first band portion, 57A', on third cradle 56A, and a first band portion, 57B', on fourth cradle 56B, and a second band portion, 57A'', on third cradle 56A, and a second band portion, 57B'', on fourth cradle 56B. Cradles 56A and 56B are made of a resilient material, again typically a polymer, each having an interior surface, 58A' and 58A'', and 58B' and 58B'', following substantially an inner portion from the intersection of two circular arc paths, as shown in part in FIG. 8, more particularly an inner portion 60A' of a first circular arc path and an inner portion 60A'' of a second circular arc path on third cradle 56A and an inner portion 60B' on a first circular arc path and an inner portion 60B'' on a second circular arc path 60B'' on fourth cradle 56B.

Each pair of opposing band portions 57A' and 57A'', and 57B' and 57B'' have a pair of supply core gaps, 62A and 62B, therebetween that opens to provide access to that columnar space partially surrounded by said opposing band portions 57A' and 57A'' and 57B' and 57B''; and a pair of tension notches, 64A and 64B, therebetween that open in a direction substantially opposed to the direction supply core gaps 62A and 62B open. Tension notches 64A and 64B connecting opposing band portions 57A' and 57A'', and 57B' and 57B'' in each of cradles 56A and 56B, respectively.

First spaced apart connecting arm 42A joins base 44 of first cradle 46A of take-up core holding portion 38 with base 54 of third cradle 56A supply core holding portion 40, and second spaced apart connecting arm 42B joins base 44 of second cradle 46B of take-up portion 38 with base 54 of fourth cradle 56B of supply core holder portion 40 to thereby space take-up core holder portion 38 apart from supply core holder portion 40.

Supply core holder portion 40 has a semi-circular cover, 66, with hinges, 68A and 68B, attached thereto, to rotatably attach cover 66 to base 54 of supply core holder portion 40. In that configuration, semi-circular cover 66 encloses any suitable ribbon core inserted therein. Insertion requires that such a ribbon core be forced through supply core gaps 62A and 62B by forcing apart opposing resilient bands 57A' and 57A'' and 57B' and 57B'', to result in that core being positioned in third cradle 56A and fourth cradle 56B. Semi-circular cover 66 has a lip, 70, located substantially opposed to hinges 68A and 68B. Lip 70 has a first protrusion 72A, and a second protrusion, 72B, where first protrusion 72A can be forced to catch in a first locking slot, 74A, through being forced into that slot, and second protrusion 72B can be forced to catch in a second locking slot, 74B, through being forced therein, when semi-circular cover 66 is placed in the closed position.

As an example, in FIGS. 4 and 5, a first ribbon core, 76, with a supply ribbon, 80, at least partially wound therearound, is shown provided in supply core holder portion 40, a result reached by inserting the ends of this core in first cradle 46A and second cradle 46B as described above. The core can be removed from these cradles by forcing these ends back through gaps 62A and 62B.

Also by example, a second ribbon core, 78, has supply ribbon 80 at least partially wound therearound, and can be provided in take-up core holder portion 38 by placing the ends of second ribbon core 78 through gaps 52A and 52B in first cradle 46A and second cradle 46B, respectively, with no substantial force required, and can be removed by lifting the ends therefrom. Semi-circular cover 66, after insertion of a core, is rotated from the open position during which first ribbon core 76 is both alternatively insertable and removable from third and fourth cradles 56A and 56B, to a closed position during which supply core holder portion 40 is not accessible.

Tension notches 64A and 64B position opposing band portion 57A' and 57A" and opposing band portions 57B' and 57B" of supply core holder portion 40 a bit closer together than the diameter of outer surfaces of either of ribbon cores 76 or 78. This results from first circular arc paths 60A' and 60B' and second circular arc paths 60A" and 60B" not having the same rotational axis. This is in contrast to resilient material bands 47A and 47B in take-up core holder portion 38 which have inner surfaces 48A and 48B, respectively, that follow corresponding circular arc paths 50A and 50B, which have substantially the same diameter as either of ribbon cores 76 or 78. The spacing of opposing band portions 57A' and 57A", and of 57B' and 57B" of supply core holder portion 40 results in the ends of second ribbon core 78, positioned in cradles 56A and 56B having an inward directed radial force which is small enough to allow, under the resulting tangential frictional forces, the advancement of supply ribbon 80 from second ribbon core 78 to first ribbon core 76 during rotation of first ribbon core 76, but still provide substantial enough drag on core 78 to prohibit slack from forming in supply ribbon 80 on the portion thereof unwrapped from second ribbon core 78 but not yet wrapped onto first ribbon core 76. In contrast, no drag exists nor is needed on take-up core holder portion 38 since when cover 16 is in a closed position and a ribbon core is placed in take-up core holder portion 38, said ribbon core is engaged.

Supply ribbon 80 typically consistws of a roll of storing material having a repeating sequence of color material sections, provided along its length, each divided by a section-end indicator. Each section contains three colored transfer material regions in a fixed order which, under heat and pressure will transfer colored material therefrom to another medium. Between the first region and the second region, and between the second region and the third region are source-end indicators. A pair of sensors is attached to an inner face, 92, of the cover 16 in the path of supply ribbon 80 to sense the section-end indicators as they pass to aid in advancing the ribbon.

A thermal printhead assembly with a thermal printhead attached thereon (not shown) is connected to inner face 92 of cover assembly 16 such that, when cover 16 is rotated from an open position to a closed position, said thermal printhead is lowered into a position nearly adjacent to supply ribbon 80 that is exposed between first ribbon core 76 and second ribbon core 78. During operation of the printer, this thermal printhead is further lowered into contact with supply ribbon 80 where deposition of coloring materials from supply ribbon 80 to a recording sheet occurs. A plurality of rollers and roller guides including a main paper drive roller, 104, a paper feed roller (not shown) and two roller guides, 108, advance the recording sheet during this process.

The thermal printhead has an array of electric resisters thereon (not shown) such that during colored material deposition, when the thermal printhead is lowered into contact with supply ribbon 80, current is caused to be established in selected electrical resisters in the array of such printhead resistors to produce heat therein that is conducted to a corresponding coloring material region on supply ribbon 80 which results in coloring material being directly deposited from that region onto a recording sheet to form a desired colored materials image thereon.

Figure 2:
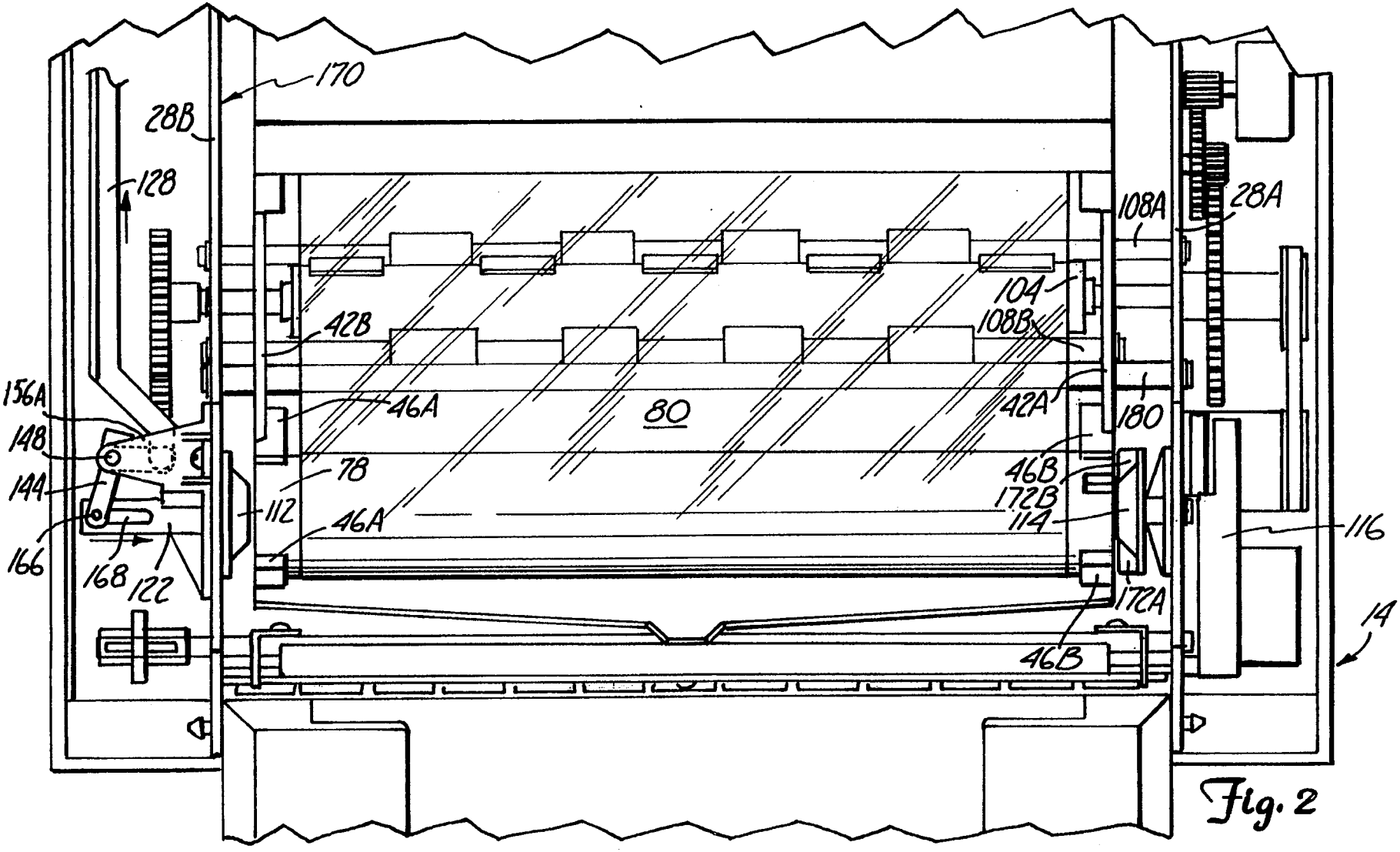
FIG. 2 is a plan view of the recorder of FIG. 1 showing the interior thereof.
Figure 7:
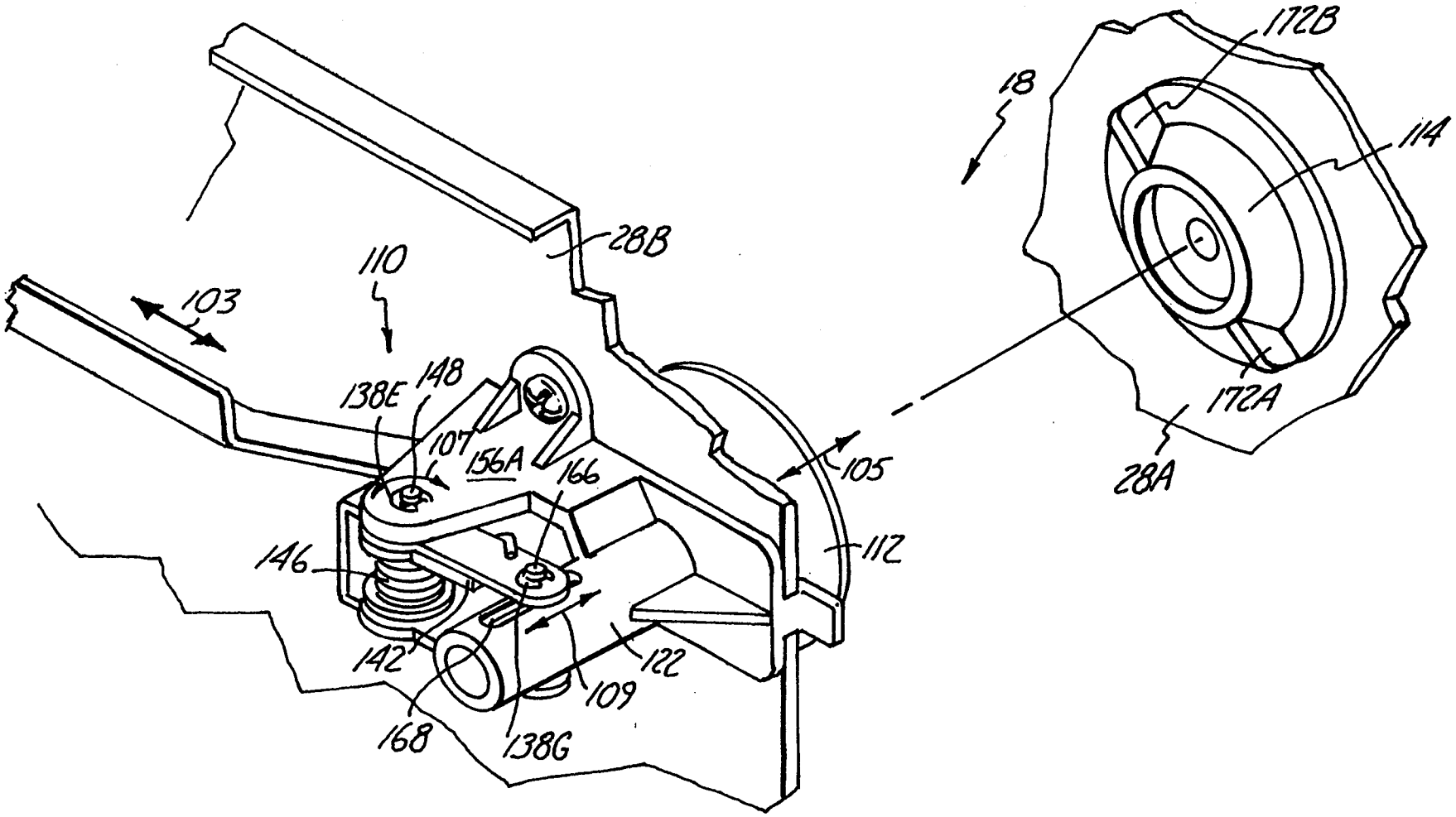
FIG. 7 is a perspective view of a portion of the recorder in FIG. 1.

The advancement of supply ribbon 80 from first ribbon core 76 to second ribbon core 78 is made possible by the closing of cover 16 which is shown on FIG. 6 on rotational shaft 24 as arrow 101. FIGS. 6 and 7 show a motion converter, 110, which actuates a core engagement hub, 112, such that second ribbon core 78, as shown in FIG. 2, is pinned between core engagement hub 112 and a drive hub, 114. Drive hub 114 is rotatably fixed to right side frame member 28A such that drive hub 114 adjoins interior space 18 while being rotatably fixed by a shaft through frame member 28A to a driving mechanism, 116, shown in FIG. 1. Driving mechanism 116, which is connected to right side frame member 28A, can be actuated by a rotary motion generator 118, more particularly an electric motor, which is connected to printer body 14 outside of interior space 18.

FIGS. 6 and 7 show core engagement hub 112 is rotatably fixed to a push shaft, 120, that passes through left side frame member 28B to be slidably mounted in a sliding cylinder, 122, that is fixed to left side frame member 28B in such a manner that the rotation of engagement hub 112 and drive hub 114 are both about a common rotational axis, an axis shared by second ribbon core 78 if placed in cradles 46A and 46B. Core engagement hub 112 slides back and forth along this rotational axis as actuated by motion converter 110 within sliding cylinder 122 which has a sliding axis that is the same axis as the rotational axis of hubs 112 and 114. Core engagement hub 112 is connected to motion converter 110 which is pushed and pulled back and forth in directions substantially orthogonal to the rotational axis of hubs 112 and 114 by the opening and closing of cover assembly 16. Motion converter 110 is also attached to rotational shaft 24 on an end portion of that shaft extending outside of interior space 18, by passing through left frame member 28B in second retaining groove 26B.

Motion converter 110 has a rotary-to-translational movement conversion means and a direct-to-lateral movement conversion means. The rotary-to-translational movement conversion means is connected to rotational shaft 24 of cover assembly 16 such that rotary movement of cover 16, as shown by arrow 101, in FIG. 6, between the open and closed positions thereof results in corresponding translational movements of a connecting push-pull rod, 128, in substantially opposed directions, as shown by arrow 103 in FIG. 7, that are substantially perpendicular to the direction in which rotational shaft 24 extends. The direct-to-lateral movement means is connected to connecting push-pull rod 128 such that movement of connecting push-pull rod 128 in substantially opposed directions, as shown by arrow 103, results in corresponding lateral back and forth movements of core engagement hub 112 along the rotational axis of hubs 112 and 114, as shown by arrow 105 in FIG. 6.

The rotary-to-translational movement conversion means includes a lever, 130, that is fixedly attached to rotational shaft 24 using a first set screw, 132. Lever 130 rotates about rotational shaft 24 during opening and closing of cover 16. Connecting push-pull rod 128 is rotationally attached to lever 130 by a pin, 136, inserted through connecting push-pull rod 128 and lever 130 with retaining rings, 138A and 138B, positioned on each end of pin 136. Connecting push-pull rod 128 thus rotates downward while moving substantially in a rearward direction when cover assembly 16 is moved from the open position thereof to the closed position thereof, while connecting rod 128 rotates upward while moving substantially in a forward direction when cover 16 is moved from the closed position thereof to the open position thereof:

Direct-to-lateral movement means comprises a forked-end link, 140, having thereon a stop, 142; and a double link, 144, with a torsion spring, 146: and a sliding cylinder, 122, such that push shaft 120 can be connected therein. Attached about an end of connecting push-pull rod 128, opposite the end thereof to which lever 130 is attached, is forked-end link 140 where a first portion, 150, thereof is attached to connecting push-pull rod 128 by a pin, 154, with retaining rings, 138C and 138D, provided about each end of this pin to retain it on this connection.

A pair of flanges, 156A and 156B, are fixed to left side frame member 28B and extend out therefrom such that flanges 156A and 156B support a pivoting pin, 148, extending downward from upper flange 156A to lower flange 156B. Forked-end link 140 is positioned in the space between flanges 156A and 156B in such a manner as to be substantially perpendicular to connecting push-pull rod 128 and attached to pivoting pin 148 through a forked or second portion, 152.

Forked portion 152 of forked-end link 140 has two substantially vertically aligned holes, 158A and 158B, therein through which pivoting pin 148 is inserted. Double link 144 has two substantially vertically aligned holes, 160A and 160B, through which pivoting pin 148 is also inserted so that forked-end link 140 is within double link 144. Retaining rings, 138E and 138F, hold pivoting pin 148 in vertically aligned holes 158A and 158B, and 160A and 160B.

Concentrically positioned about pivoting pin 148 within forked-end link 140 is torsion spring 146 acting to provide torsional force between forked-end link 140 and double link 144. Torsion spring 146 urges double link 144 into a perpendicular position with reference to forked end link 140 whereas stop 142 attached to forked-end link 140 prohibits further spring action. Stop 142, which is perpendicular to forked-end link 140 that stop 142 is attached to, is parallel to an upper outwardly extending portion, 162A, on double link 144.

Double link 144 has upper outwardly extending portion 162A and a lower outwardly extending portion, 162B, where outwardly extending portions 162A and 162B create a gap, 164. A sliding pin, 166, extends through gap 164 and thus therebetween upper outwardly extending portion 162A of double link 144 and lower outwardly extending portion 162B of double link and through a closed longitudinal slot, 168, in sliding cylinder 122 that is positioned in gap and through a hole, 169, in push shaft 120. Retaining rings, 138G and 138H, hold sliding pin 166 in place.

Closed longitudinal slot 168 and sliding cylinder 122 are substantially perpendicular to double link 144. Slidably mounted in sliding cylinder 122 is push shaft 120. Sliding pin 166 is fixedly connected into push shaft 120 such that movement of double link 144 causes sliding pin 166 to actuate in longitudinal slot 168. This actuation within longitudinal slot 168 moves push shaft 120 within sliding cylinder 122 based upon the constraints of longitudinal slot 168.

When cover assembly 16 is in the open position, sliding pin 166 is in a portion of the longitudinal shaft which is furthest away from left side 28B while engagement hub 112, which is attached at the opposite end of push shaft 120, is flush with an inner face, 170, as shown in FIG. 2, of left side 28B such that engagement hub 112 faces interior space 18. When cover 16 is rotated out of the open position and toward the closed position, rotational shaft 24 rotates, as shown by arrow 101 in FIG. 6, such that lever 130, which is fixedly attached, rotates downwardly and out of a horizontal forwardly position. This downward rotation of lever 130 causes the rotationally attached connecting pushpull rod 128 to follow and therefore move substantially rearwardly in the horizontal direction, as shown by arrow 103 in FIG. 7, while rotating slightly downwardly in the vertical direction. This motion results in first portion 150 of forked-end link 140 rotating substantially rearwardly about pivotal pin 148.

When forked-end link 140 rotates, stop 142 follows causing double link 144 to rotate inwardly toward left side 28B. This inward rotation of double link 144, as shown by arrow 107 in FIG. 7, causes sliding pin 166 in longitudinal slot 168 to move from the outward position to the inward position thereby causing push shaft 120 in sliding cylinder 122 to slide inward, as shown by arrow 109 in FIG. 7, pushing engagement hub 112 out of the position flush with inner face 170 of left side 28B. Engagement hub 112 is pushed further into interior space 18 and if second ribbon core 78 is positioned between engagement hub 112 and drive hub 114, then engagement hub 112 comes into contact with second ribbon core 78.

Figure 3:
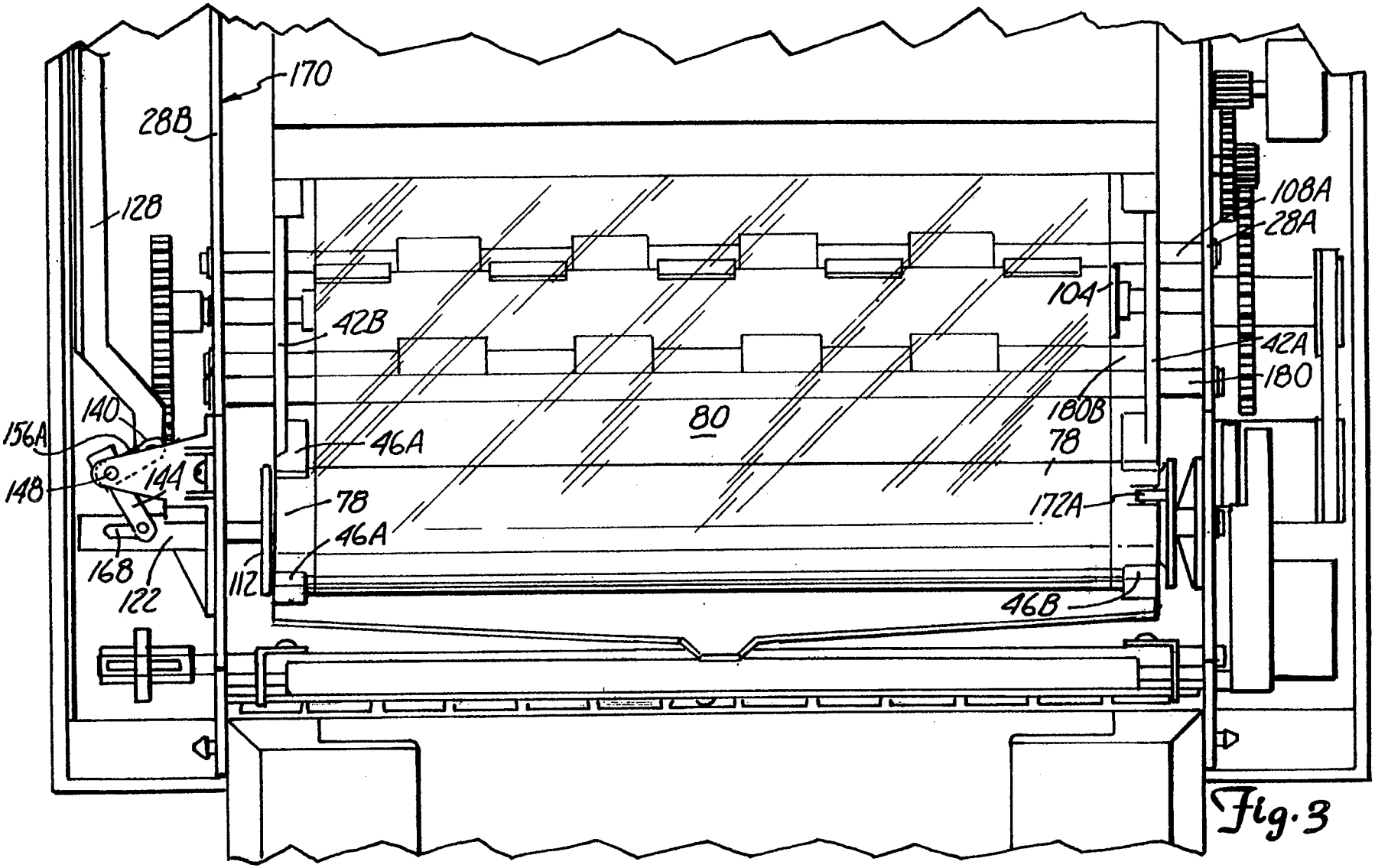
FIG. 3 is a plan view of the recorder of FIG. 1 showing the interior thereof.

FIG. 2 shows drive hub 114 has core engagement means consisting of two splines 172A and 172B positioned. FIG. 3 shows that when second ribbon core 78 is in an engaged position and drive hub 114 is being rotated, these splines 172A and 172B within one half of a rotation will engage two locking notches 174A and 174B, as shown in FIGS. 4 and 5, in second ribbon core 78 thereby allowing second ribbon core 78 to be selectively rotated thus advancing supply ribbon 80. Deposition of coloring materials can now occur.

To remove a ribbon cassette 36, cover assembly 16 is opened resulting in reversal of the above sequence. In short, cover 16 is selectively rotated from a closed position to an open position resulting in rotational shaft 24 rotating, as shown by arrow 101 in FIG. 6, such that lever 130 rotates upwardly and back toward a horizontal forwardly position. This upward rotation of lever 130 causes the rotationally attached connecting push-pull rod 128 to follow and therefore move substantially forwardly in the horizontal direction, as shown by arrow 103 in FIG. 7, while rotating slightly upwardly in the vertical direction. This motion results in first portion 150 of forked-end link 140 rotating substantially forwardly about pivotal pin 148.

When forked-end link 140 rotates, stop 142 follows causing double link 144 to rotate outwardly away from left side 28B. This outward rotation of double link 144, as shown by arrow 107 in FIG. 7, causes sliding pin 166 in longitudinal slot 168 to move from the inward position to the outward position thereby causing push shaft 120 in sliding cylinder 122 to slide outward, as shown by arrow 109 in FIG. 7, pulling engagement hub 112 out of contact with second ribbon core 78.

FIG. 4 shows ribbon cassette 36 as positioned in space 18 when cover 16 is in an open position such that core engagement hub 112 and drive hub 114 have not engaged roller 78 positioned therebetween. As FIG. 4 shows, roller 78 merely rests and cradles 46A and 46B such that take up core holder portion 38 may not be aligned with the rotational axis that exists between core engagement hub 112 and drive hub 114. When cover 16 is moved into a closed position, as shown in FIG. 5, roller 78 is engaged and forced into axial alignment with the rotational axis running between core engagement hub 112 and drive hub 114. The engagement of roller 78 results in ribbon cassette 36 being lifted off of rotatable resting bar, 180, such that a gap, 182, appears.

FIG. 6 shows a switching mechanism, 190, which is attached to left side 28B such that a switch plate, 192, activates a switch, 194, indicating the closing of cover 16 thereby allowing printing functions to occur.

Thus, the printer can only print when the cover 16 is in the closed position. The motion converter 110 makes insertion of new ribbon cassettes an easy process involving merely opening the cover 16, the removing of the ribbon cassette therein, inserting a new cassette, and closing the cover 16. The act of opening the cover automatically disengages the second ribbon core 78 therein, and after replacement of that ribbon core, the act of closing the cover 16 automatically re-engages the ribbon core inserted therein as a replacement.

When a ribbon cassette has been properly inserted and the cover 16 has been rotated to the closed position thereby both causing the core engagement hub 112 to engage a second ribbon core against the drive hub 114, and a switching mechanism 190 for a thermal printhead to be activated, the process of color printing or recording on a recording sheet, such as either paper or transparencies, can occur.

Coloring printing involves the recording sheets being loaded into the paper tray, followed by signals being received from an outside source indicating the design and colors to be printed. At this point a print command is given and an internal circuit proceeds through a number of steps resulting in a final color printed document. These steps include causing the paper feed roller to engage one recording sheet and pull the recording sheet into and partially through main paper drive roller 104 while roller guides 108 keep the recording sheet following the desired path. When the recording sheet is at the proper starting point, the thermal printhead is lowered into contact with the supply ribbon. Rotation of the drive hub 114 and thus the take-up core holder portion 38 and supply ribbon 80 occurs while the paper feed roller is advancing the sheet resulting in deposition of coloring materials from the first coloring material source onto the recording sheet.

Upon completion thereof which is indicated by the sensors sensing the first source-end indicator, the paper feed roller is reversed and the recording sheet is pulled back to the proper starting point. The above steps are then repeated for each of the remaining color panels provided in a color panel sequence in ribbon 130.

Although the present invention has been described with reference to preferred embodiments, workers skilled in the art will recognize that changes may be made in form and detail without departing from the spirit and scope of the invention.

What is claimed is:

1. An entry controlled ribbon core engager for a recorder having an interior space accessible through a cover means that is selectively movable between an open position, in which a ribbon core having a supply ribbon at least partially wound therearound can selectively be provided in said interior space and removed therefrom, and a closed position, in which such providing and removing is prevented, said ribbon core engager comprising:

a drive hub means located in said interior space having a drive hub portion that is selectively rotatable about a hub axis, said drive hub portion having a core engagement means for engaging a said ribbon core forced thereagainst to correspondingly force rotation of that said ribbon core when said drive hub portion is rotated;

a positioning hub means located in said interior space having a positioning hub portion spaced apart from said drive hub portion along said hub axis and being movable back and forth along, and rotatable about, said hub axis such that a said ribbon core can be positioned between said positioning hub and said drive hub portions when said positioning hub means is moved back from said drive hub portion; and a motion converter means connected to both said cover means and said positioning hub means so as to move said positioning hub portion back and forth along said hub axis when said cover means is correspondingly moved between said open and closed positions therefor, whereby said cover means being placed in said open position therefor causes said positioning hub portion to be positioned back from said drive hub portion, and said cover means being placed in said closed position therefor causes said positioning hub portion to be positioned toward said drive hub portion to thereby force any said ribbon core positioned therebetween against said core engagement means.

2. The apparatus of claim 1 wherein a said ribbon core is providable in a ribbon cassette, and is positionable between said drive hub portion and said positioning hub portion, and removed from therebetween, by inserting said ribbon cassette into, and removing said cassette from, said interior space when said cover means is in said open position therefor.

3. The apparatus of claim 1 wherein said cover means is pivotally mounted and said motion converter means has a rotary-to-translational movement means therein having a portion of a connecting arm connected thereto such that moving said cover means between said open and closed positions therefor results in corresponding movements in substantially opposed directions of said connecting arm.

4. The apparatus of claim 3 wherein said motion converter means further has a direct-to-lateral movement means having a portion of said connecting arm connected thereto such that moving said connecting arm in said substantially opposed directions results in back and forth movements of said positioning hub portion.

5. The apparatus of claim 1 further comprising a shaft extending outside said interior space and connected to a rotary motion generator positioned exterior to said interior space, said drive hub portion being on said shaft to permit selectively rotating said drive hub portion by said generator.

6. The apparatus of claim 5 wherein at least a portion of one of said motion converting means and said positioning hub means extends outside said interior space.

7. A recorder having an interior space accessible through a cover means that is selectively movable between an open position, in which a ribbon core having a supply ribbon at least partially wound therearound can selectively be provided in said interior space and removed therefrom, and a closed position, in which such providing and removing is prevented, said recorder comprising:

a ribbon core engager positioned at said interior space comprising:

a drive hub means located in said interior space having a drive hub portion that is selectively rotatable about a hub axis, said drive hub portion having a core engagement means for engaging a said ribbon core forced thereagainst to correspondingly force rotation of that said ribbon core when said drive hub portion is rotated;

a positioning hub means located in said interior space having a positioning hub portion spaced apart from said drive hub portion along said hub axis and being movable back and forth along, and rotatable about, said hub axis such that a said ribbon core can be positioned between said positioning hub and said drive hub portions when said positioning hub means is moved back from said drive hub portion; and a motion converter means connected to both said cover means and said positioning hub means so as to move said positioning hub portion back and forth along said hub axis when said cover means is correspondingly moved between said open and closed positions therefor, whereby said cover means being placed in said open position therefor causes said positioning hub portion to be positioned back from said drive hub portion, and said cover means being placed in said closed position therefor causes said positioning hub portion to be positioned toward said drive hub portion to thereby force any said ribbon core positioned therebetween against said core engagement means; and a thermal printhead in said cover means having electrical resistors therein that are forced against said supply ribbon to in turn be forced against a recording sheet, if correspondingly positioned in said recorder, when said cover means is in said closed position therefor, said electrical resistors being capable of being heated sufficiently by electrical currents therethrough to cause depositions of materials in said supply ribbon onto said recording sheet.

8. A recorder having an interior space accessible through a cover means that is selectively movable between an open position, in which a ribbon core having a supply ribbon at least partially wound therearound can selectively be provided in said interior space and removed therefrom, and a closed position, in which such providing and removing is prevented, said recorder comprising:

a ribbon core engager positioned at said interior space comprising:

a drive hub means located in said interior space having a drive hub portion that is selectively rotatable about a hub axis, said drive hub portion having a core engagement means for engaging a said ribbon core forced thereagainst to correspondingly force rotation of that said ribbon core when said drive hub portion is rotated;

a positioning hub means located in said interior space having a positioning hub portion spaced apart from said drive hub portion along said hub axis and being movable back and forth along, and rotatable about, said hub axis such that a said ribbon core can be positioned between said positioning hub and said drive hub portions when said positioning hub means is moved back from said drive hub portion; and a motion converter means connected to both said cover means and said positioning hub means so as to move said positioning hub portion back and forth along said hub axis when said cover means is correspondingly moved between said open and closed positions therefor, whereby said cover means being placed in said open position therefor causes said positioning hub portion to be positioned back from said drive hub portion, and said cover means being placed in said closed position therefor causes said positioning hub portion to be positioned toward said drive hub portion to thereby force any said ribbon core positioned therebetween against said core engagement means; and a said ribbon core provided in a ribbon cassette to be positionable between said hub drive portion and said positioning hub portion, and removable from therebetween, by inserting said ribbon cassette into, and removing said ribbon cassette from, said interior space when said cover means is said open position; and a thermal printhead in said cover means having electrical resistors therein that are forced against said supply ribbon through an opening in said ribbon cassette to in turn be forced against a recording sheet, if correspondingly positioned in said recorder, through a further opening in said ribbon cassette when said cover means is in said closed position therefor, said electrical resistors being capable of being heated sufficiently by electrical currents therethrough to cause depositions of materials in said supply ribbon onto said recording sheet.

9. The apparatus of claim 8 wherein said recorder has a rod positioned in said interior space substantially parallel to said hub axis, and said ribbon cassette has a take-up core holder portion for holding a take-up ribbon core and a supply core holder portion for holding a supply ribbon core on each of which cores a supply ribbon is partially wound, and further has a pair of connecting arms each joining a corresponding part of said take-up portion with a corresponding part of said supply portion to thereby space them apart from one another, each said connecting arm forming at least a portion of those sides defining a notch where said ribbon cassette is supported on said rod when said positioning hub portion is positioned back from said drive hub portion.

* * * * *

UNITED STATES PATENT AND TRADEMARK OFFICE

CERTIFICATE OF CORRECTION

PATENT NO. :5,378,072

DATED :January 3, 1995

INVENTOR(S) :ERNEST M. GUNDERSON

It is certified that error appears in the above-indentified patent and that said Letters Patent is hereby corrected as shown below:

Col. 9, line 60, delete "ribbon 130", insert --ribbon 80--

Signed and Sealed this

Twenty-sixth Day of December, 1995

*Attest:*

BRUCE LEHMAN

*Attesting Officer*

*Commissioner of Patents and Trademarks*